US005524719A

United States Patent [19]

Dennis

[11] Patent Number: 5,524,719

[45] Date of Patent: Jun. 11, 1996

[54] INTERNALLY REINFORCED POLYCRYSTALLING ABRASIVE INSERT

[75] Inventor: Mahlon D. Dennis, Kingwood, Tex.

[73] Assignee: Dennis Tool Company, Houston, Tex.

[21] Appl. No.: 507,551

[22] Filed: Jul. 26, 1995

[51] Int. Cl.[6] ..... E21B 10/36

[52] U.S. Cl. ..... 175/432; 175/434; 76/DIG. 12

[58] Field of Search ..... 175/428, 432, 175/434, 405.1; 76/108.4, DIG. 11, DIG. 12

[56] References Cited

U.S. PATENT DOCUMENTS

| | | | |
|---|---|---|---|
| 4,403,015 | 9/1983 | Nakai et al. | 175/434 |
| 4,604,106 | 8/1986 | Hall et al. | 175/434 X |
| 4,605,343 | 8/1986 | Hibbs et al. | 175/434 X |
| 4,681,174 | 7/1987 | Aubakirov et al. | 175/405.1 |
| 4,884,477 | 12/1989 | Smith et al | 76/108 |
| 5,335,738 | 8/1994 | Waldenstrom et al. | 175/434 X |
| 5,348,109 | 10/1994 | Griffin | 175/434 |

*Primary Examiner*—Roger J. Schoeppel
*Attorney, Agent, or Firm*—Gunn & Associates

[57] ABSTRACT

An insert for a drill bit is set forth. The insert is formed with an elongate body, typically having a cylindrical cross section terminating at an exposed outer end. The outer end is covered with a polycrystalline disc. In the present disclosure, the polycrystalline disc is reinforced with an insert which is wholly captured in the polycrystalline material. In one form, a circular disc is set forth. In another aspect, multiple reinforcing members can be incorporated. They have the form of multiple discs. This reduces stress concentration in the polycrystalline clad insert.

20 Claims, 1 Drawing Sheet

INTERNALLY REINFORCED POLYCRYSTALLING ABRASIVE INSERT

BACKGROUND OF THE DISCLOSURE

The present disclosure is directed to an abrasive insert for a drilling machine such as a drill bit or other wear applications. It is typically an insert which is formed of very hard material, and which is equipped with a superhard polycrystalline or CBN layer on the leading edge or face of the insert. It is not uncommon to place superhard polycrystalline or CBN material on the end of an insert which bears against the rock formations being drilled by the drill bit so that the cap bears the brunt of the impact during drilling operations. This rather common arrangement enables the insert to last much longer. Typically, the superhard layer of polycrystalline or CBN is attached by sintering at selected extremely high temperatures or pressures. The interface between the layer and the hard material insert is a location at which substantial stress is concentrated, and it may well fail at the unwanted stress concentrations in that area. When that occurs, the stress concentration is sufficient to fracture the cap or face material at the interface. Also, the stresses can build up in the polycrystalline or CBN and cause fracture elsewhere in the polycrystalline or CBN cap.

The preferred superhard materials include polycrystalline or CBN. The polycrystalline material is manmade diamond, and more particularly polycrystalline diamond compact, a material formed to a desired shape and having characteristics of diamond. In other words, it is diamond like in hardness and other physical characteristics. Another hard material is CBN, more precisely, cubic boron nitride.

The polycrystalline or CBN cap formed on the insert has many advantages. With these advantages, there is one major detrimental aspect which primarily relates to the brittleness of the polycrystalline material. In other words, the polycrystalline cap is typically brittle and susceptible to fracture when stress is concentrated. To overcome this, the present disclosure proposes to provide a reinforcing structure within the polycrystalline layer so that the polycrystalline material has modified performance characteristics on the insert. The advance of the present invention particularly focuses on changing the polycrystalline layer. As before, the polycrystalline material is installed as manufactured. It is formed typically as a circular cap on the end of the insert. Even more so, it is able to handle the stresses which are encountered by virtue of the incorporation of reinforcing material within the polycrystalline cap. In this particular disclosure, the polycrystalline material is provided with a centralized disc. This disc is included fully surrounded by the polycrystalline material. This disc is incorporated completely within the polycrystalline material. It has the form of one or more circular reinforcing members which are comparable in shape to the polycrystalline disc but the reinforcing disc in the polycrystalline layer is preferably spaced so that it is approximately at the center position. It is preferably round and smaller than the polycrystalline layer. It is preferably formed of a material which is sufficiently ductile or bendable to avoid breaking. The ductility is greater in this embodiment. One material is high cobalt content cemented tungsten carbide or the like. It is able to withstand substantial flexure and does not work harden with time. The reinforcing insert in the polycrystalline material carries stress in the polycrystalline layer to the reinforcing member. This reinforcing member is constructed and installed so that the relief mechanism is in the polycrystalline disc.

ADDED REINFORCING MEMBER

In one aspect of the present disclosure, another type of reinforcing material is set forth. In this particular instance, the insert is provided with the polycrystalline layer or cap on the end of the insert which is attached in a manner to be described. In the polycrystalline layer, the reinforcing member is a disc with a smooth or knurled surface. Preferably, the reinforcing member is formed of a material which has a hardness of 8 or more mohs and which typically is a carbide material. Typical reinforcement materials include tungsten carbide, tungsten boride, tungsten nitride, tungsten silicide, molybdenum carbide, niobium carbide, boron carbide, tantalum carbide, titanium carbide, silicon carbide, and so on. Typically, these are formed from carbide particles with a selected cement holding these particles together. In addition, newly available binderless materials such as "Roctec" which is a tungsten carbide/molydbenum carbide can also be used in this invention. Metal discs of refractory metals (e.g., tungsten, tantalum, zirconium, molydbenum) are also used. Preferably, the discs has a size from about 0.1 to 2.0 mm thickness and a diameter slightly less than the polycrystalline diameter. Extremely small discs do not provide the intended benefit in the same measure as do larger discs. Randomly distributed, they are located on the interior of the polycrystallines. Preferably, they do not contact the edge because the greater benefit is provided when submerged fully within the polycrystalline material. Moreover, the polycrystalline material of the present disclosure is constructed so that the randomly distributed discs accommodate stressed regions and in fact direct the stress into the discs where the circular inserts are able to handle the stress of usage more readily by plastic deformation. Also, the disc promotes localized polycrystalline bonding of the hard material crystals.

To summarize, the present disclosure provides an insert which can be installed in a drill bit and which withstands shock loading more readily than a polycrystalline layer bonded to the insert without the reinforcing members set forth in accordance with the present disclosure. The insert is preferably a disc to approximate the polycrystalline shape but other shapes can be used recognizing they are often inferior to the disc.

IN THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may add to other equally effective embodiments.

FIG. 1 is a sectional view through the polycrystalline cap or layer bonded to the end of an insert wherein the polycrystalline layer encloses a concentrically positioned reinforcing member formed of metal wherein the sectional cut line for FIG. 1 is at the line 1—1 in FIG. 2 of the drawings;

FIG. 2 of the drawings is a sectional view taken along the line 2—2 of the insert shown in FIG. 1 further illustrating the relative position of the reinforcing member in the polycrystalline layer which enables construction of an improved insert;

DETAILED DESCRIPTION OF THE PREFERRED EMBODIMENT

Figure 1:
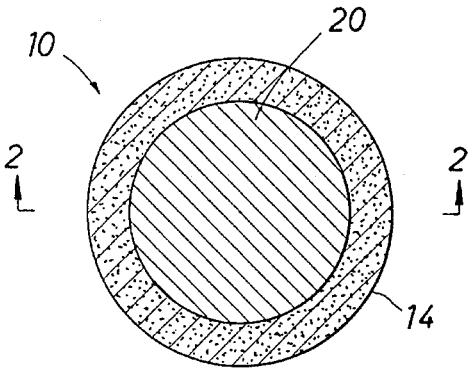

Attention is now directed to FIG. 1 of the drawings which shows in sectional view a polycrystalline layer joined to the end of an insert (see FIG. 2) which is indicated generally by the numeral 10. The manufactured product with the polycrystalline layer on the end is thus illustrated in FIG. 2 of the drawings. It is joined to an insert body typically formed of cylindrical construction and which is identified at 12. Typically, it is formed with the specified right cylindrical construction although that is not mandated for the insert 10. Moreover, the insert body is formed of a hard metal which has a lower end positioned in a matching opening formed in the drill bit body or one of the cones of the drill bit. Typically, the body 12 is affixed to the drill bit by positioning in the hole with an interference fit. The interference fit holds the insert body at the specified location and enables the insert to hold to the body during use. The remote or exposed end of the insert body 12 then has a reinforced polycrystalline layer 14. The layer 14 is joined at the interface 16 by brazing or sintering in a diamond press. The polycrystalline layer conforms typically to the shape or profile of the insert body, and assuming a cylindrical insert body, then the polycrystalline layer 14 is cylindrical also. It is common to form the polycrystalline layer to a specified thickness. Typical thickness is about 0.5 to 2.0 mm. It is relatively limited in size to handle substantial wear and tear during use. Typically, it is worn by stress failures which occur with shock loading as the insert grinds against hard rock formations during drilling.

The disc of polycrystalline material 14 is formed by sintering the polycrystalline material in place. While it is possible to form polycrystalline as a separate disc, it is also possible to form this as a disc which conforms in profile to the interface 16. Thus the disc 14 matches the insert 12 in diameter. Moreover, the polycrystalline disc can be fabricated matching the insert to assure such conformity in shape and diameter. Whether formed separately or formed in a molding process which uses the insert, the polycrystalline disc is joined to the insert body 12. Sintering or brazing completes the joinder process so that the polycrystalline disc provides the requisite protection required during use. In the present instance, the polycrystalline material is preferably formed by a separate manufacturing process which involves casting particulate polycrystalline material in a fashion believed to be well known. This material is formed to a desired shape and size in a molding process involving very high temperatures and pressures applied to the material, and the heated material is shaped to the shape of the mold. In the present instance, it is assumed that the molded disc is relatively uniform in thickness and has a circular shape or profile. It is also assumed but not required that the disc be flat. In fact, the top face can be flat, curved, undulating, conic, stepped or have some other shape.

Figure 2:
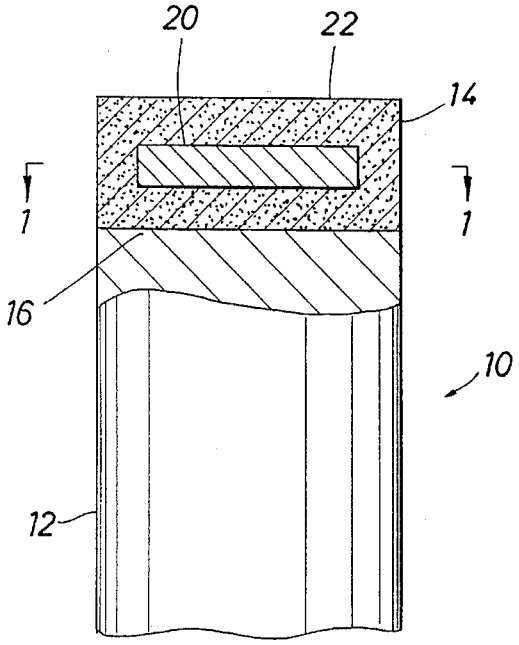
Figure 3:
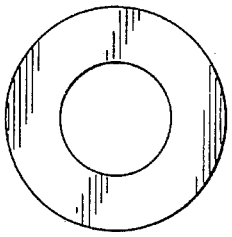
FIG. 3 shows an alternate reinforcing member.
Figure 4:
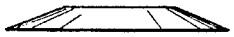
FIG. 4 shows an alternate reinforcing member.
Figure 5:
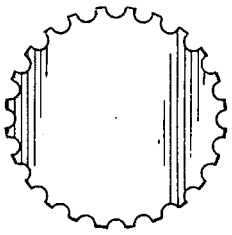
FIG. 5 shows an alternate reinforcing member.
Figure 6:
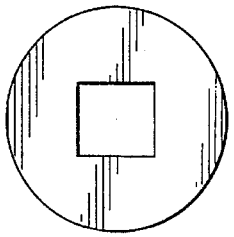
FIG. 6 shows an alternate reinforcing member.
Figure 7:
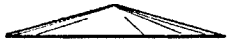
FIG. 7 shows an alternate reinforcing member.

The polycrystalline disc is made in the ordinary fashion. It is molded to dimensions that are dictated by the diameter of the insert body 12 and the desired thickness of the polycrystalline disc. It is however provided with a reinforcing member 20 which has the form of a centralized reinforcing member. Going now to the location of the reinforcing member, the member 20 is positioned in the polycrystalline disc at the time of fabrication and is ideally centralized. In the preferred form, it has the form of a circular disc which is located in the larger fabricated circular disc and is therefore relatively central. It is desirable that the disc 20 not contact any sidewall. This contact will create an undesirable stress concentration at the region of contact. Rather, it is fully surrounded by the polycrystalline material. The reinforcing member 20 is often constructed of a high cobalt content tungsten carbide. It is preferably tough and yet able to strain with stress. It is a material which does not work harden with ordinary use. The carbide reinforcing member 20 is shown in FIG. 2 of the drawings spaced approximately between the end face 22 and the interface 16. The thickness of the member 20 is controlled so that there is substantial thickness of polycrystalline material which surrounds the reinforcing insert 20. In the illustrated embodiment, the reinforcing member 20 has a thickness of about 20–50% of the thickness of the polycrystalline disc 14. While it can be made thicker or thinner, there is no particular gain in going to these extremes in dimensions. Rather, it is desirable that the polycrystalline disc 14 be provided with the reinforcing insert 20 having a thickness in the range given above. In terms of diameter, preferably there is some clearance around the insert, the clearance being the difference in the radius of the reinforcing member 20 in comparison with the polycrystalline disc 14. The member 20 may have many shapes beginning with a circle which is the easiest to make but it can be a washer with a central hole, a planar washer with an irregular edge, or concave or convex sheet disc, or have a variable thickness, shown herein.

The completed insert 10 of the present disclosure operates more successfully in a drill bit. When shock loading occurs, there is a shock stress wave transmitted into the polycrystalline body. It is substantially absorbed at the reinforcing member 20. Since the reinforcing member is formed of a material which is able to absorb the stress without the risk of breaking as a brittle material, the polycrystalline material is thereby protected. This enables a reduction of stress concentrations in the polycrystalline disc which might otherwise cause an unwanted fracture.

Going now to one benefit of the present system, when wear and tear during the ordinary use of the drill bit occurs, there typically is a tendency to chip around the top circular edge of the polycrystalline disc 14. When that occurs, the stress which is encountered in this construction is observed in the polycrystalline disc at the upper regions thereof. This prevents stress buildup which might otherwise damage or destroy the disc 14 by causing it to fracture across the disc. Failures in this mode have occurred in the past, and the reinforcing member 20 prevents this type of failure as a substantial benefit.

FIGS. 3 to 7 show reinforcing members including respectively a planar washer, a conic washer, a notched solid member, a washer featuring a non-round hole and a conic or crowned washer.

While the foregoing is directed to the preferred embodiments, the scope is determined by the claims which follow.

What is claimed is:

1. An abrasive insert for use in drilling, machining or wear applications comprising:

(a) an insert body having an end portion;

(b) a cap on said insert body at the end portion thereof wherein said cap is joined thereto, and said cap is formed of molded diamond or diamond like material; and (c) an enclosed reinforcing member in said cap wherein said reinforcing member is formed of a material less brittle than said molded diamond or diamond like material and said reinforcing member is able to stress with the use of said cap.

2. The insert of claim 1 wherein said insert body is an elongate cylindrical member of right cylinder construction, has an exposed end portion terminating in a circle, and said cap entirely covers said end portion and is circular in shape.

3. The apparatus of claim 2 wherein said reinforcing member is a circular metal insert within said cap and is located so that said reinforcing member does not extend to any sidewall or face of said cap.

4. The apparatus of claim 3 wherein said reinforcing member is between about 20% and 50% of the thickness of said cap.

5. The insert of claim 4 wherein said reinforcing member is a flat circular disc.

6. The insert of claim 5 wherein said reinforcing member is a hard machine tool steel, and a disc of uniform thickness.

7. The apparatus of claim 1 wherein said reinforcing member is a plurality of cemented carbide platelets formed into a specified shape and said member does not extend to any edge or sidewall of said cap.

8. The apparatus of claim 1 wherein said reinforcing member is formed of a refractory metal or alloy thereof.

9. The apparatus of claim 1 wherein said reinforcing members is a metal insert and is located so that said reinforcing member does not extend to any sidewall or face of said cap.

10. The apparatus of claim 9 wherein said reinforcing member is a planar washer.

11. The apparatus of claim 9 wherein said reinforcing member is a conic washer.

12. The apparatus of claim 9 wherein said reinforcing member is a notched washer.

13. The apparatus of claim 9 wherein said reinforcing member is a crowned washer.

14. The apparatus of claim 9 wherein said reinforcing member is a washer having a central hole.

15. An insert for use in a drill bit wherein the insert is positioned in a drill bit body or cone and is adapted to make contact with hard formations during drilling, the insert comprising:

(a) an insert body of elongate cylindrical construction having an exposed outer end portion;

(b) a covering over the end portion of said insert wherein the covering is constructed with a cast material to thereby provide a covering of specified thickness and having a cross sectional shape and area matching the end portion of said insert wherein said covering is adapted to encounter formation during drilling and is subjected to shock loading in use; and (c) within said covering, a reinforcing member having a form approximating a member of a specified minimum diameter so that said reinforcing member is fully imbedded within said covering, and wherein said reinforcing member is formed of hard materials able to strain during stress and are less brittle than said covering.

16. The apparatus of claim 15 wherein said reinforcing member is a planar washer.

17. The apparatus of claim 15 wherein said reinforcing member is a conic washer.

18. The apparatus of claim 15 wherein said reinforcing member is a notched washer.

19. The apparatus of claim 15 wherein said reinforcing member is a crowned washer.

20. The apparatus of claim 15 wherein said reinforcing member is a washer having a central hole.

* * * * *